US008382237B2

(12) United States Patent
Tojo

(10) Patent No.: US 8,382,237 B2
(45) Date of Patent: Feb. 26, 2013

(54) LIQUID EJECTING APPARATUS

(75) Inventor: Seiji Tojo, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 1616 days.

(21) Appl. No.: 11/781,751

(22) Filed: Jul. 23, 2007

(65) Prior Publication Data

US 2008/0018698 A1 Jan. 24, 2008

(30) Foreign Application Priority Data

Jul. 24, 2006 (JP) ..... 2006-200400

(51) Int. Cl.
*B41J 2/165* (2006.01)

(52) U.S. Cl. ..... 347/30; 347/32

(58) Field of Classification Search ..... 347/29, 347/30, 32

See application file for complete search history.

(56) References Cited

U.S. PATENT DOCUMENTS 6,467,872 B1 * 10/2002 Yamada et al. ..... 347/30

FOREIGN PATENT DOCUMENTS

| | | |
|---|---|---|
| JP | 09-131882 | 5/1997 |
| JP | 10-211717 | 8/1998 |
| JP | 11-170562 | 6/1999 |
| JP | 2001-347689 | 12/2001 |
| JP | 2004-358792 | 12/2004 |
| JP | 2005-329693 | 12/2005 |

* cited by examiner

*Primary Examiner* — Kevin S Wood

(74) *Attorney, Agent, or Firm* — Workman Nydegger

(57) ABSTRACT

A liquid ejecting apparatus comprising a liquid ejecting head that ejects liquid from nozzles; a carriage capable of carrying the liquid ejecting head; a plurality of cap spaces capable of covering the nozzles; a suction pump capable of applying a negative pressure to each of the cap spaces so as to suck liquid from the nozzles; a plurality of suction channels that communicate with the plurality of cap spaces and carry the liquid sucked by the suction pump; a channel selection means for selecting one or more suction channels for cutting off the communication with the cap spaces based on the position of the carriage; and a communication cut-off means for cutting off the communication of the one or more suction channels selected by the channel selecting means.

13 Claims, 10 Drawing Sheets

FIRST POSITION

SECOND POSITION

THIRD POSITION

LIQUID EJECTING APPARATUS

BACKGROUND

The entire disclosure of Japanese Patent Application No. 2006-200400, filed Jul. 24, 2006 is expressly incorporated herein by reference.

1. Technical Field

The present invention relates to a liquid ejecting apparatus. More specifically, the present invention relates to a liquid ejecting apparatus capable of securely capping the liquid ejecting nozzles in a inexpensive and secure manner.

2. Related Art

One example of a liquid ejecting apparatuses which eject liquid onto a target is an ink jet recording apparatus which records print data onto a recording sheet by ejecting ink droplets from nozzles onto the recording sheet. In such apparatuses, however, many printing defects may occur, such as increased ink viscosity caused by evaporation of solvents from the openings of the nozzles, dust adhesion in the openings of the nozzles, and the mixing of bubbles in the ink caused by replacement of a cartridge, and the like.

In order to ensure that the nozzles are operating properly, a cap for capping the nozzle faces is typically used to cover the nozzle faces of the recording head when the apparatus is not printing. An ink absorber is placed inside the cap to keep the humidity inside the cap high during capping in order to prevent evaporation of the solvent through the nozzle openings, in an attempt to prevent the increase in the viscosity of ink.

In addition, an exhaust port is formed in the bottom surface of the cap to discharge ink or bubbles which is connected to a tube fixed to the cap. A suction pump is attached to the tube, and a negative pressure is applied to the inside of the cap by a suction operation of the suction pump. A cleaning operation is also performed by discharging any ink with an increased viscosity or bubbles caused by the replacement of the ink cartridge.

A cleaning device has been developed, which includes a plurality of recording heads and a plurality of caps covering the recording heads, wherein a suction operation may be performed individually or collectively on the recording heads. In such a cleaning device, a negative pressure supply switching unit is provided which selectively switches the supply of negative pressure to the caps. When the negative pressure supply switching unit selects a cap, the supply of negative pressure and the suction pump is driven, such that negative pressure is supplied to the cap connected to the suction pump, causing a suction operation to be performed on the recording head corresponding to the cap. With this arrangement, it is possible to selectively perform a suction operation on the caps.

One example of an apparatus which performs a suction operation on the caps is disclosed in Japanese Patent Application JP-A-2001-347689, which discloses an apparatus wherein the supply of negative pressure is selected by the phase control of a rotating cam. The rotating cam serves as a negative pressure supply switching unit that selectively presses and blocks the tubes in communication with the caps. Moreover, Japanese Patent Application JP-A-2004-358792 discloses an apparatus in which a cap is selected by a valve operation, and Japanese Patent Application JP-A-2005-329693 discloses an apparatus wherein the cap is selected by a cylindrical cam-based valve operation.

One difficulty in the apparatus in which the cap is selected using the phase control of the rotating cam, is that it is necessary to have a motor for driving the rotating cam as well as a sensor for detecting the phase of the rotating cam, meaning that the cost of the apparatus is increased. And in the apparatuses where the cap is selected by the valve operation, it is necessary to have a complex mechanism such as a valve in the ink flow path, which increases the likelihood of clogging when using pigment ink, which is undesirable in view of long term reliability.

SUMMARY

An advantage of some aspects of the invention is that it provides a liquid ejecting apparatus capable of selecting a cap for suction in a secure manner and at low cost.

One aspect of the invention is a liquid ejecting apparatus comprising a liquid ejecting head capable of ejecting liquid from nozzles, a carriage capable of carrying the liquid ejecting head in a main scanning direction in a reciprocating manner, a plurality of cap spaces capable of capping nozzle faces so as to cover the nozzles of the liquid ejecting head, a suction pump capable of applying a negative pressure to each of the cap spaces so as to suck liquid from the nozzles, a plurality of suction channels which communicate with the plurality of cap spaces, so as to remove the liquid sucked by the suction pump, channel selection means for selecting one or more suction channels for cutting off the communication to the cap spaces based on the position of the carriage, and a communication cut-off means for cutting off the communication of the suction channels selected by the channel selecting means.

In the apparatus of the invention, the suction channels are selected on the basis of the position of the carriage, and the communication of the suction channels to the cap spaces is maintained or cut off based on the selection. By using this system, liquid is selectively sucked from the nozzles corresponding to the cap spaces. Thus, one aspect of the invention is the ability to select a cap space for liquid suction, based on the position of the carriage. Advantageously, since the suction channels are selected by the movement of the carriage carrying the recording head, unlike the known art, it is not necessary to have a rotating cam control means or sensor, meaning that it is possible to select the cap space for suction at low cost without complicating installation work. In addition, since the selection of suction channels is performed using the carriage, which is subject to highly precise positioning and/or movement control, it is possible to select the cap for suction in a secure manner. Therefore, it is possible to select the cap space for suction at low cost without complicating installation work.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a first embodiment of the invention will be described with reference to FIGS. 1 to 9, in which the invention is embodied in a cleaning device of an ink jet printer.

Figure 1:
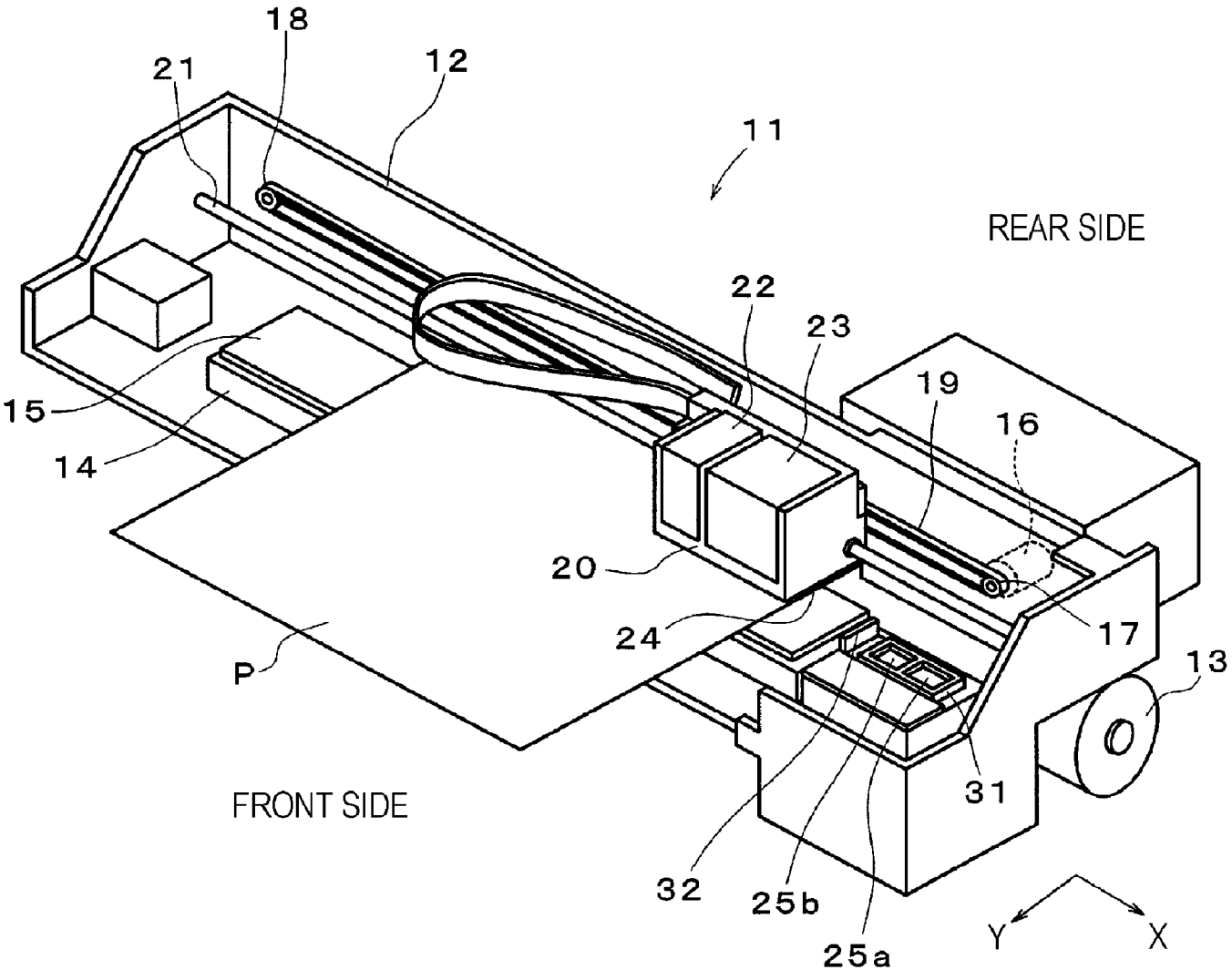
FIG. 1 is a perspective view of an ink jet recording apparatus in accordance with an embodiment of the invention.

As shown in FIG. 1, a paper feeding mechanism is provided in a frame 12 of an ink jet recording apparatus 11. The paper feeding mechanism is equipped with a paper feeding motor 13 fixed to a lower portion on the rear side of the frame 12 and a drive roller (not shown), which is connected to the output shaft of the paper feeding motor 13. The drive roller rotates with the driving of the paper feeding motor 13, and paper P is transported toward the front side of the ink jet recording apparatus 11 from the rear side; i.e., the paper P is transported in the direction indicated by the arrow Y in FIG. 1, and is used as a target for the apparatus 11.

A waste liquid tank 14 containing used ink therein extends in the longitudinal direction (i.e., in the direction indicated by the arrow X in FIG. 1) in the inner bottom surface of the frame 12. Above the waste liquid tank 14, a platen 15, acting as a support member, is disposed along the waste liquid tank 14. The platen 15 is a support table that supports the paper P. The paper P transported by the driving of the paper feeding motor 13 is guided onto the top surface of the platen 15.

A carriage motor 16 is fixed to the outer surface of the side wall on the rear side of the frame 12. The output shaft of the carriage motor 16 penetrates the side wall on the rear side of the frame 12, and a drive pulley 17 is fixed to the front end of the output shaft. A driven pulley 18 is rotatably supported on the inner surface of the side wall on the rear side of the frame 12 with a predetermined distance from the drive pulley 17 in the longitudinal direction of the frame 12. An endless belt 19 is stretched between the drive pulley 17 and the driven pulley 18. A carriage 20 that carries a recording head 24, described more fully below, is fixed to the belt 19 and is capable of moving in a main scanning direction in a reciprocating manner.

A guide member 21 extending parallel to the platen is provided between the opposing side walls of the frame 12. The guide member 21 is inserted through the carriage 20 so that the carriage 20 slides along the guide member 21. The drive pulley 17 rotates with the driving of the carriage motor 16. As a result, the carriage 20 reciprocates in the longitudinal direction (i.e., the main scanning direction that is the X-axis direction in FIG. 1) while being supported by the guide member 21.

Two ink cartridges 22 and 23 are detachably mounted on the carriage 20. By way of example, the ink cartridge 22 contains black ink. In contrast, the inner space of the ink cartridge 23 is partitioned into three chambers containing magenta, cyan, and yellow.

Figure 2:
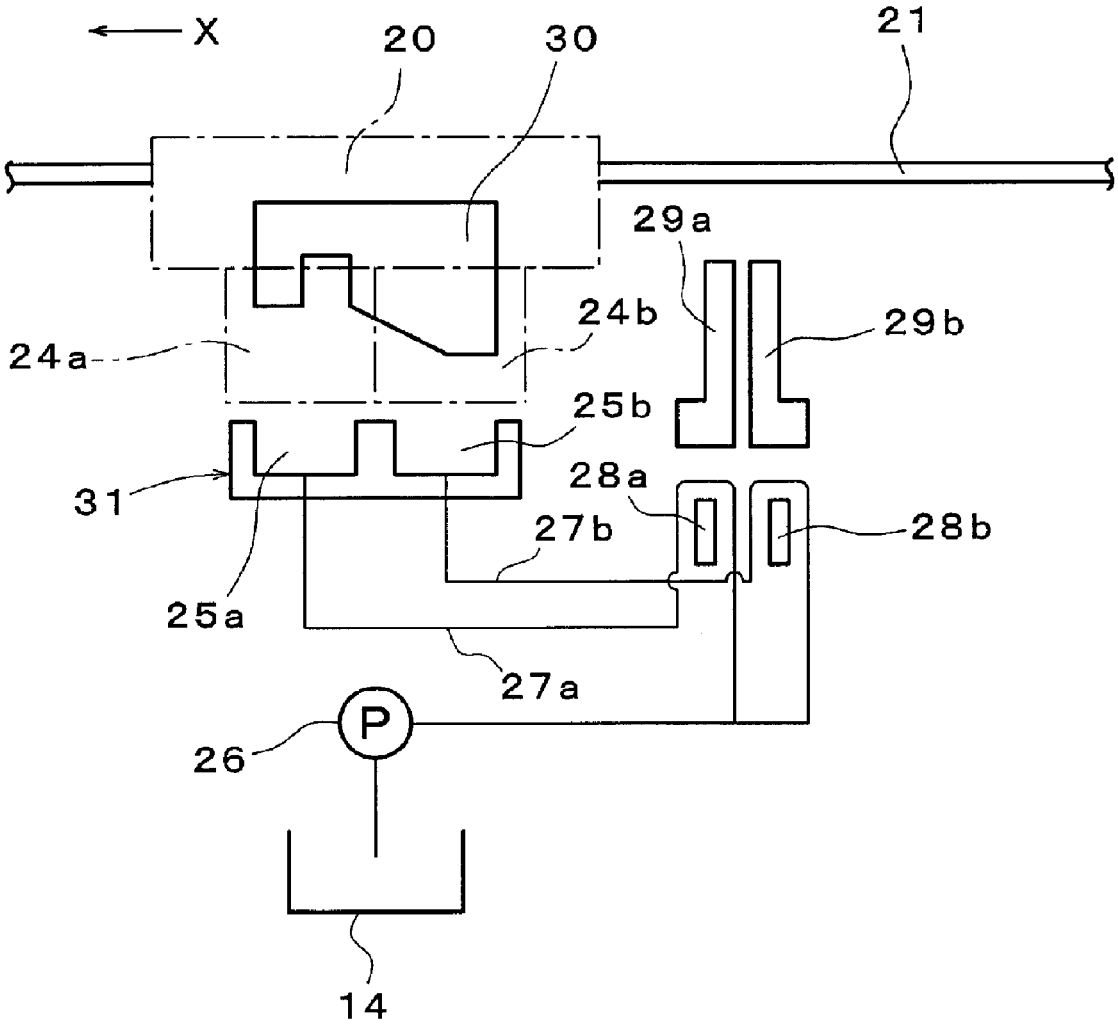
FIG. 2 is a schematic view of a cleaning mechanism of the recording apparatus.

As shown in FIG. 2, on the bottom surface (i.e., the side surface on the platen 15 side) of the carriage 20, a recording head 24, which acts as a liquid ejecting head, ejecting a liquid such as ink. In the present embodiment, the recording head 24 is composed of a first recording head 24*a* and a second recording head 24*b*. Each of the first and second recording heads 24*a* and 24*b* includes a plurality of nozzles (not shown) that open downward. A piezoelectric element (not shown) is provided in each nozzle. With the driving of the piezoelectric element, ink (or other liquid) is supplied from the ink cartridges 22 and 23 to the first and second recording heads 24*a* and 24*b*. The ink is then ejected onto paper P on the platen 15 from the nozzles of the first and second recording heads 24*a* and 24*b*.

In the present embodiment, the first recording head 24*a* communicates with the ink cartridge 23 containing color ink and ejects the color ink, and the second recording head 24*b* communicates with the ink cartridge 22 containing black ink and ejects the black ink.

A non-printable area (a home position) is located in one side portion of the frame 12. A cap member 31 and a wiping member 32 are disposed in the non-printable area as means for cleaning the recording head 24.

The cap member 31 is provided with a plurality of cap spaces 25 that are opened upward and capable of capping the nozzle faces so as to cover the nozzles of the recording head 24. In the present embodiment, a first cap space 25*a* and a second cap space 25*b* are provided to correspond to the first recording head 24*a* and the second recording head 24*b*, respectively.

The cap member 31 is moved toward and away from the nozzle faces of the first and second recording heads 24*a* and 24*b* by cap lifting means (not shown). When the cap member 31 is moved upward, the upper end of the cap member 31 makes close contact with the nozzle faces of the first and second recording heads 24*a* and 24*b*. Then, the nozzles formed on the nozzle faces of the first recording head 24*a* are capped by the cap member 31, and the nozzles are sealed with the cap space 25*a*. Simultaneously, nozzles formed on the nozzle faces of the second recording head 24*b* are capped by the cap member 31, and the nozzles are sealed with the cap space 25*b*.

A suction pump 26 is further provided, which is capable of applying a negative pressure to each of the cap spaces 25*a* and 25*b* so as to suck ink from the nozzles of the recording head 24 that are capped. The first cap space 25*a* communicates with the suction pump 26 via a first tube member 27*a*, and the second cap space 25*b* communicates with the suction pump 26 via a second tube member 27*b*. Internal channels of the first tube member 27*a* and the second tube member 27*b* serve as a plurality of suction channels for communicating with the plurality of cap spaces 25*a* and 25*b*, respectively, so as to remove the liquid sucked by the suction pump 26.

When the suction pump 26 is in a state wherein the first and second recording heads 24*a* and 24*b* are capped by the cap member 31, negative pressure is applied to the first and second cap spaces 25*a* and 25*b* via the first and second tube members 27*a* and 27*b*, respectively. Using the negative pressure, ink is sucked from the nozzles of the first and second recording heads 24*a* and 24*b*. The ink then fills the first and second cap spaces 25*a* and 25*b* and flows toward the suction pump 26 through the first and second tube members 27*a* and 27*b*, respectively. Then, the ink is discharged into the waste liquid tank 14.

The recording apparatus includes a channel selection means for selecting one or more tube members for which the communication is to be cut off among the plurality of tube members serving as suction channels, based on the position of the carriage 20. The recording apparatus also includes a communication cut-off means for cutting off the communication of the one or more tube members selected by the channel selecting means.

More specifically, portions of the first and second tube members 27*a* and 27*b* are disposed above a first tube seat 28*a* and a second tube seat 28*b*, respectively.

A first lever member 29*a* is disposed above the first tube seat 28*a* on which a portion of the first tube member 27*a* is placed. When the first lever member 29*a* is operated, the first tube member 27*a* is compressed between the first tube seat 28*a* and the first lever member 29*a*, blocking the suction channel formed by the first tube member 27*a*.

Similarly, a second lever member 29*b* is disposed above the second tube seat 28*b* on which a portion of the second tube member 27*b* is placed. When the second lever member 29*b* is operated, the second tube member 27*b* is compressed between the second tube seat 28*b* and the second lever member 29*b*, blocking the suction channel formed by the second tube member 27*b*.

The carriage 20 is provided with a plate-like heteromorphic member 30 that reciprocates in the main scanning direction with the reciprocating movement of the carriage 20. The heteromorphic member 30 is configured to select one of the lever members 29 and move the selected lever members 29 based on the movement of the carriage 20.

The communication cut-off means is configured to include the lever members 29 that are provided to correspond to the flexible tube members 27 which form the suction channels. The lever members are configured to perform a lever operation so as to press and block corresponding tube members 29. The channel selecting means is configured to select the corresponding tube members 27 by selecting one of the lever members 29.

Next, the heteromorphic member 20 and the lever members 29 will be described in detail. In this example, it is assumed that there is only one lever member 29 and one tube member 27.

Figure 3:
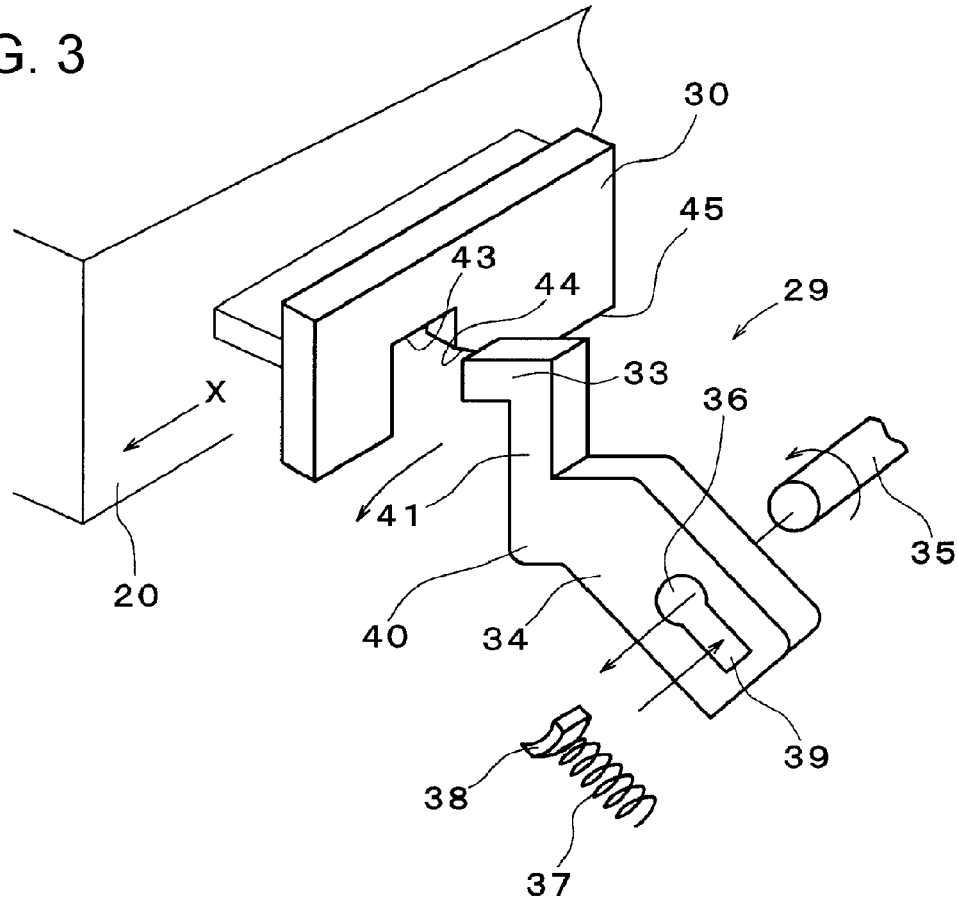
FIG. 3 is an exploded perspective view of a lever member.

As shown in FIG. 3, the lever member 29 is generally formed from a single body comprising a head portion 33, a neck portion extending downward from the base of the head portion 33, and a body portion. In the base of the neck portion 41, a pressing portion 40 is formed that protrudes forward to press and block the tube member 27.

A shaft insertion hole 36 is bored through the body portion 34 so that a shaft 35 is inserted into the shaft insertion hole 36. Continuous with the shaft insertion hole 36, an opening 39 is bored through the body portion 34 so as to receive a bias member 37 for pressing and biasing a friction member 38 against the outer circumferential surface of the shaft.

The shaft 35 is inserted into the shaft insertion hole 36, and the friction member 38 is pressed and biased against the outer circumferential surface of the shaft such that the bias member 37 and the friction member 38 are received in the opening 39. Together, the shaft 35, the bias member 37, and the friction member 38 constitute a friction clutch.

When the shaft 35 rotates in the direction of the arrow shown in FIG. 3, the lever member 29 pivots back and forth with the rotation of the shaft 35. Due to the frictional force acting between the shaft 35 and the friction member 38, the lever member 29 moves in such a way that the head portion 33 leans forward. In this example, the shaft 35 is parallel to the main scanning direction (the X-axis direction in the drawing), that is, the shaft is parallel with the guide member 21. In this example, the shaft 35 is rotated by the paper feeding motor 13.

Figure 4:
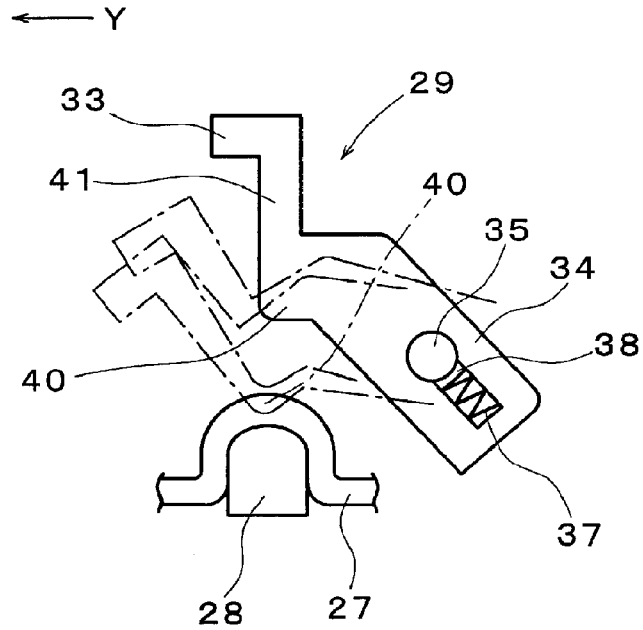
FIG. 4 is a side view of the lever member, illustrating the operation thereof.

FIG. 4 shows the state in which the lever member 29 is pivoted in a forward leaning manner. In such a state, when the lever member 29 is further pivoted so as to perform the lever operation described more fully below, the tube member 27 is pressed and blocked by the pressing portion 40 of the lever member 29.

When the front end of the head portion 33 that is pivoted in a forward leaning manner receives force stronger than the frictional force acting between the shaft 35 and the friction member 38, the force causes the pivot operation of the lever member 29 to stop (referred to as a "pivot stopping force"). For example, the pivot stopping force occurs when a stopping member makes abutting contact with the front end of the head portion 33. Then, the shaft 35 slips over the friction member 38 and rotates idly, while the pivot operation of the lever member 29 is stopped. In this example, a heteromorphic member 30 functions as the stopping member (see FIG. 3).

Figure 5A:
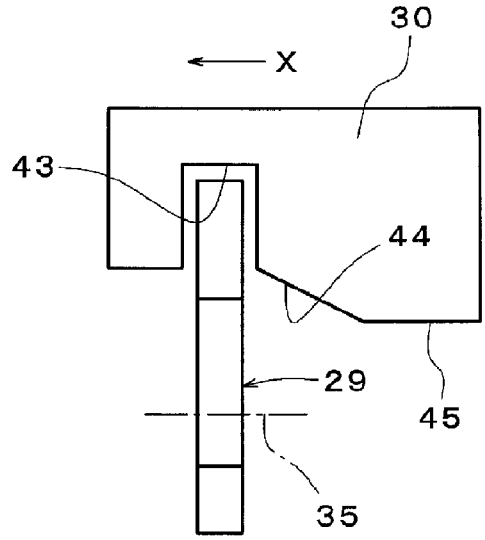
FIGS. 5A to 5C are rear views of the lever member and a heteromorphic member, illustrating the operations thereof.
Figure 5B:
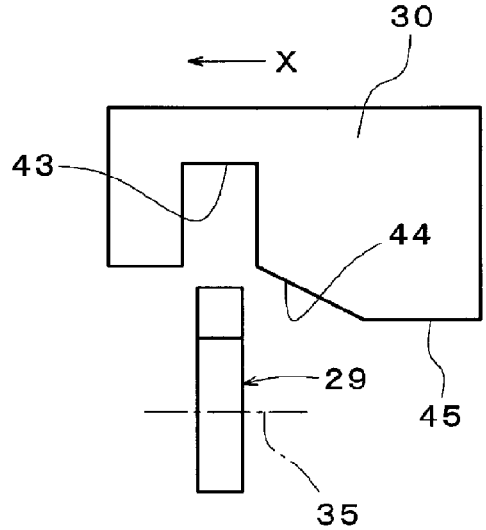
Figure 5C:
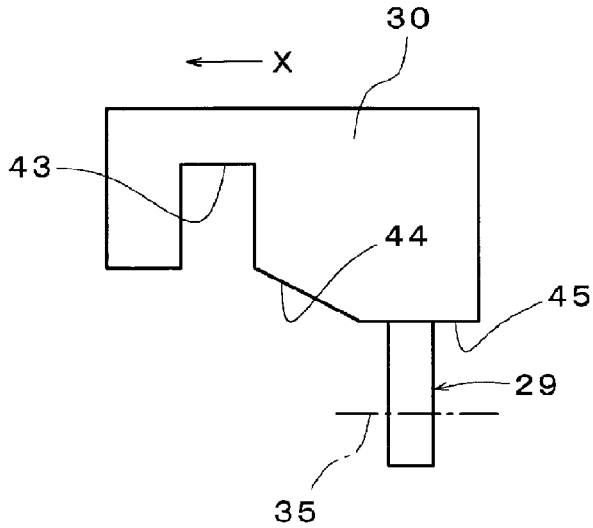
Figure 6A:
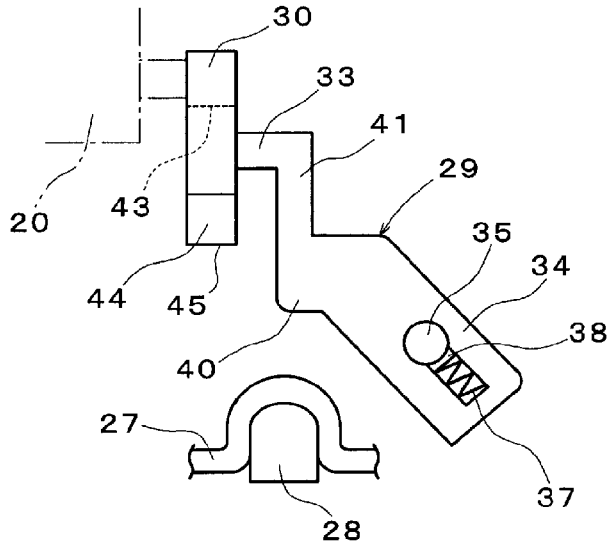
FIGS. 6A to 6C are side views of the lever member and the heteromorphic member, illustrating the operations thereof.
Figure 6B:
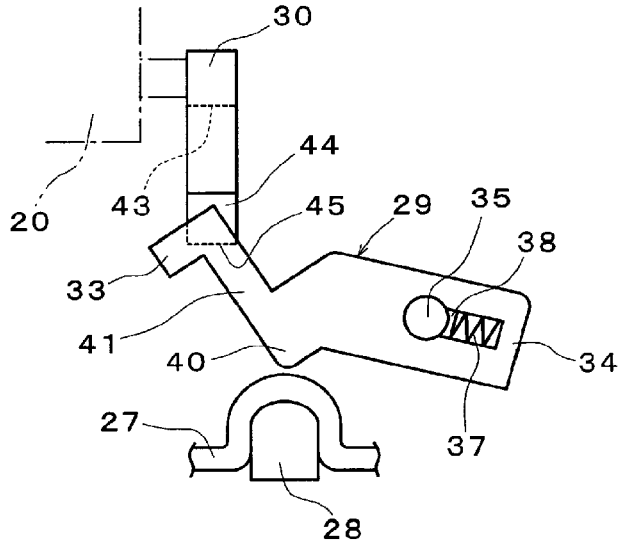
Figure 6C:
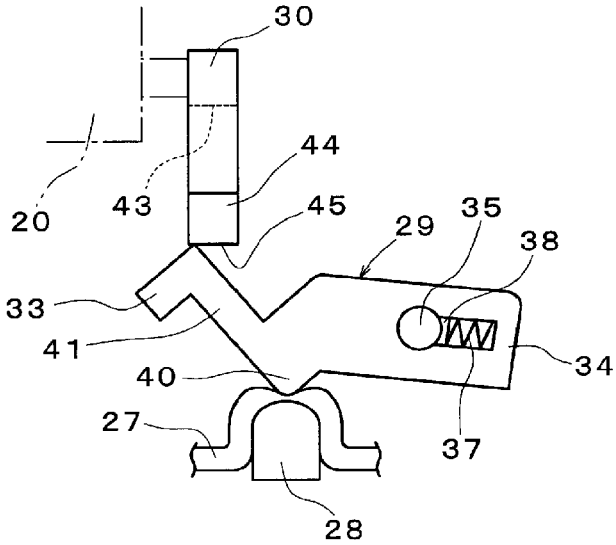

FIGS. 5A to 5C show the state in which the lever member 29 is selected and performs a lever operation based on the position of the heteromorphic member 30 accompanied by the movement of the carriage 20 (i.e., on the basis of the position of the carriage 20). FIGS. 6A to 6C are side views of the states in FIGS. 5A to 5C, respectively.

In this example, the heteromorphic member 30 is a plate member. In FIGS. 2 and 5A to 5C, the heteromorphic member 30 is viewed from the rear side of the recording apparatus. The home position is located on the left side of the drawing showing a rear view, and the pintable area is located on the right side thereof.

The heteromorphic member 30 is fixed to the rear surface of the carriage 20, and the lever member 29 is disposed on the rear surface with the front end of the head portion 33 opposed to the heteromorphic member 30 (see FIG. 3). One surface of the heteromorphic member 30 is parallel to the main scanning direction (the X-axis direction in the drawing). The rear surface of the heteromorphic member 30 is also substantially parallel to the ink-ejecting direction.

One portion of the heteromorphic member 30 includes a cutout portion 43 formed with a width which allows the insertion of the head portion 33 and the neck portion 41 of the lever member 29. On the side of the cutout portion 43 opposite the home position, an inclined surface 44 slopes down from the lower end of the cutout portion 43 toward the printable area and meets a horizontal portion 45. That is, the horizontal portion 45 is formed further out toward the printable area.

Next, descriptions will be made for the embodiment of the invention wherein the lever member 29 is selected based of the position of the carriage 20, using the lever member 29 and its friction clutch and the heteromorphic member 30 moving along with the reciprocating movement of the carriage 20.

First, the carriage 20 is moved into a position wherein the head portion 33 of the lever member 29 opposes the cutout portion 43 of the heteromorphic member 30, as shown in FIGS. 5A and 6A. In this state, the shaft 35 axially supporting the lever member 29 is rotated by the driving of the paper feeding motor 13, which also serves as the lever driving means.

As shown in FIGS. 5B and 6B, the lever member 29 pivots back and forth. The head portion 33 and the neck portion 41 of the lever member 29 are inserted into the cutout portion 43. The lever member 29 is pivoted until the rear end of the head portion 33 is disposed at a height corresponding to the inclined surface 44. Using the pivot operation of the lever member 29 and the insertion thereof into the cutout portion 43, the lever member 29 is selected.

Thereafter, as shown in FIGS. 5C and 6C, by moving the carriage 20 further out toward the home position, the inclined surface 44 is brought into contact with the rear end of the head portion 33 of the lever member 29. When the carriage 20 is further moved in the same direction, the lever member 29 is pivoted in such a way that the rear end of the head portion 33 is pressed against the inclined surface 44, and the lever member 29 performs the lever operation. By moving the carriage 20, the lever member 29 is further operated until the rear end of the head portion 33 makes abutting contact with the horizontal portion 45. In this state, the pressing portion 40 of the lever member 29 presses the tube member 27 so that the tube member 27 is pressed and blocked between the tube seat 28 and the pressing portion 40. As a result, the communication of the suction channel formed by the tube member 27 is cut off.

Meanwhile, to restore the communication of the suction channel, the carriage 20 is moved to a position (as shown in FIG. 5A) in which the head portion 33 of the lever member 29 is inserted into the cutout portion 43 of the heteromorphic member 30. Then, by rotating the shaft 35 in a reverse direction so as to return back to the original position (as shown in FIG. 6A), the tube member 27 restores the normal shape and the communication of the suction channel is recovered.

Hereinabove, selection of the lever members 29 was described assuming that there is one lever member 29 by way of example. Hereinafter, descriptions will be made of the case where one lever member 29 is selected from the first and second lever members 29*a* and 29*b*.

Figure 7A:
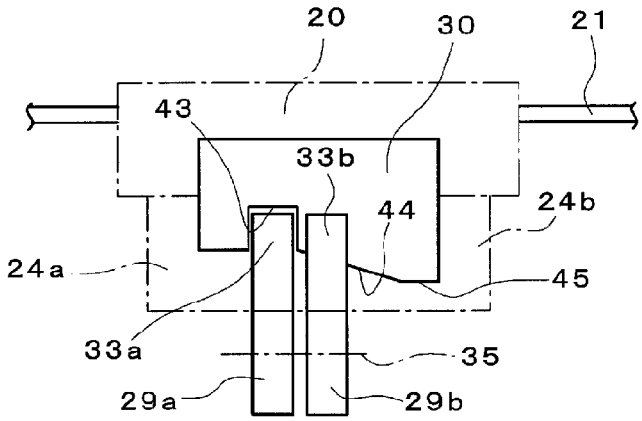
FIGS. 7A to 7C are rear views of the lever member showing the position of a carriage relative to the lever member.
Figure 7B:
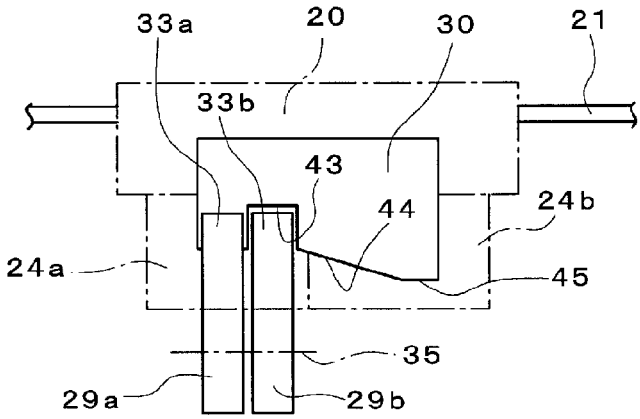
Figure 7C:
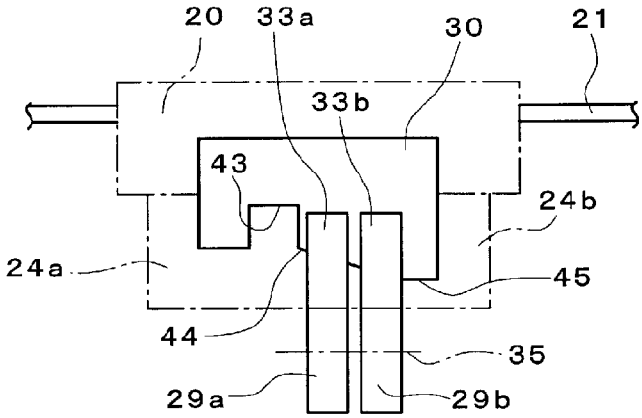

FIGS. 7A to 7B are diagrams for explaining a selecting position wherein one lever is selected from the first and second lever members 29*a* and 29*b* on the basis of the position of the carriage 20 (or the heteromorphic member 30). FIG. 7A shows a first position at which the first lever member 29*a* is selected for the lever operation. FIG. 7B shows a second position at which the second lever member 29*b* is selected for the lever operation. FIG. 7C shows a third position at which neither the first nor the second lever members 29*a* and 29*b* is selected for the lever operation.

As illustrated in the drawings, the width of the cutout portion 43 of the heteromorphic member 30 is sized to allow individual insertion of the first or second lever members 29*a* and 29*b* but not simultaneous insertion of both members.

As shown in FIG. 7A, in the first position, the head portion 33*a* of the first lever member 29*a* opposes the cutout portion 43 of the heteromorphic member 30 while the head portion 33*b* of the second lever member 29*b* opposes a plate portion of the heteromorphic member 30. When the shaft 35 rotates in this state, the head portion 33*a* of the first lever member 29*a* is inserted into the cutout portion 43 and is thus selected for the lever operation. Meanwhile, the head portion 33*b* of the second lever member 29*b* makes contact with the plate portion of the heteromorphic member 30 stopping the pivot operation of the second lever member 29*b*. As described above, although the second lever member 29*b* is provided with the friction clutch, the friction clutch cannot stop the rotation of the shaft 35 itself. Therefore, the first lever member 29*a* continues its pivot operation and is then operated to press and block the first tube member 27*a*. Meanwhile, the second lever member 29*b* is not operated and thus the second tube member 27*b* is not pressed or blocked.

As shown in FIG. 7B, in the second position, the head portion 33*b* of the second lever member 29*b* opposes the cutout portion 43 of the heteromorphic member 30 while the head portion 33*a* of the first lever member 29*a* opposes a plate portion of the heteromorphic member 30. When the shaft 35 rotates in this state, the head portion 33*b* of the second lever member 29*b* is inserted into the cutout portion 43 and is thus selected for the lever operation. Meanwhile, the head portion 33*a* of the first lever member 29*a* makes contact with the plate portion of the heteromorphic member 30 and thus the pivot operation of the first lever member 29*a* is stopped. As described above, although the first lever member 29*a* is provided with the friction clutch, the friction clutch does not stop the rotation of the shaft 35. Therefore, the second lever member 29*b* continues its pivot operation and presses and blocks the second tube member 27*b*. Meanwhile, the first lever member 29*a* is not operated and thus the first tube member 27*a* is not pressed or blocked.

As shown in FIG. 7C, in the third position, both head portions 33*a* and 33*b* of the first and second lever members 29*a* and 29*b* oppose plate portions of the heteromorphic member 30. When the shaft 35 rotates in this state, both head portions 33*a* and 33*b* of the first and second lever members 29*a* and 29*b* make contact with the plate portions of the heteromorphic member 30 and thus the pivot operation of the first and second lever members 29*a* and 29*b* is stopped. Therefore, neither the first nor the second lever members 29*a* and 29*b* are operated and thus the first and second tube members 27*a* and 27*b* are not pressed or blocked.

As described above, the channel selecting means of the present embodiment is configured to include a lever selecting section provided in the carriage 20 and operable to select one or more of the lever members 29 to be operated on the basis of the position of the carriage 20. The lever members 29 capable of pivoting back and forth with the driving of the paper feeding motor 13 serving as the lever driving means, and the carriage 20 is provided with the heteromorphic member 30, which acts as the drive stopping member that makes contact with the lever members 29 in order to stop the lever members 29. The lever selecting means is the cutout portion 43 that is bored through the heteromorphic member 30 as the drive stopping means. The lever member 29 to be operated is selected when the lever member 29 is inserted into the cutout portion 43 by the driving of the lever driving means.

In the present embodiment, the channel cut-off means includes a lever activating section provided in the carriage 20 which allows the lever members 29 selected by the lever selecting section to perform the lever operation while the carriage 20 moves. The lever activating section is the inclined surface 44 that presses the selected lever members 29 so as to perform the lever operation while the carriage 29 is moving. The lever members are selected when they are inserted into the cutout portion 43 by the driving of the lever driving means. The communication cut-off means cuts off the suction channel of the tube member 27 corresponding to the lever member.

Using this arrangement, the recording apparatus of the present embodiment is able to select the cap spaces 25*a* and 25*b* for suction and the selection of the recording heads 24*a* and 24*b* for cleaning.

First, the case where the first lever member 29*a* is selected for a lever operation will be described. During this process, the first tube member 27*a* is blocked while maintaining the communication of the second tube member 27*b*, and a suction operation is performed on the second suction space 25*b*, causing a cleaning operation to be performed on the second recording head 24*b*.

Figure 8A:
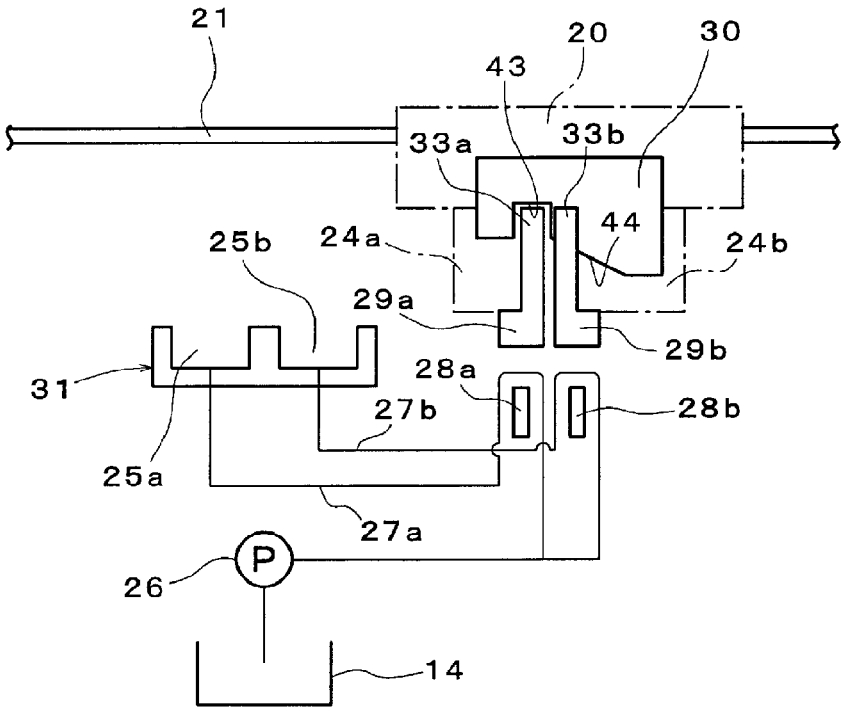
FIGS. 8A and 8B are diagrams illustrating the operation of a cleaning mechanism of the recording apparatus.

As shown in FIG. 8A, after a predetermined cleaning time, the carriage 20 is moved to one of the lever selecting positions, for example the first position (see FIG. 7A).

As described above, by rotating the shaft 35 in this state, the head portion 33*a* of the first lever member 29*a* is inserted into the cutout portion 43 and is thus selected for the lever operation, while the head portion 33*b* of the second lever member 29*b* makes contact with the plate portion of the heteromorphic member 30 and thus stops the pivot operation of the second lever member 29*b*. The first lever member 29*a* is pivoted until the rear end of the head portion 33*a* is disposed at a height corresponding to the inclined surface 44, and then the pivot operation thereof is stopped. Then, the carriage 20 is further moved toward the home position and the first lever member 29*a* is pivoted in such a way that the rear end of the head portion 33*a* is pressed against the inclined surface 44, causing the first lever member 29*a* to perform the lever operation. With the lever operation, the pressing portion 40 of the first lever member 29*a* is pressed and blocked in such a way that the inner surfaces thereof are in close contact with each other. Accordingly, the communication of the suction channel formed by the first tube member 27*a* is cut off.

Subsequently, the cap member 31 is moved upward to bring the upper end of the cap member 31 into close contact with the nozzle faces of the first and second recording heads 24*a* and 24*b*. Then, the nozzle faces of the first recording head 24*a* are capped by the first cap space 25*a*, and the nozzle faces of the second recording head 24*b* are capped by the second cap space 25*b*.

Figure 8B:
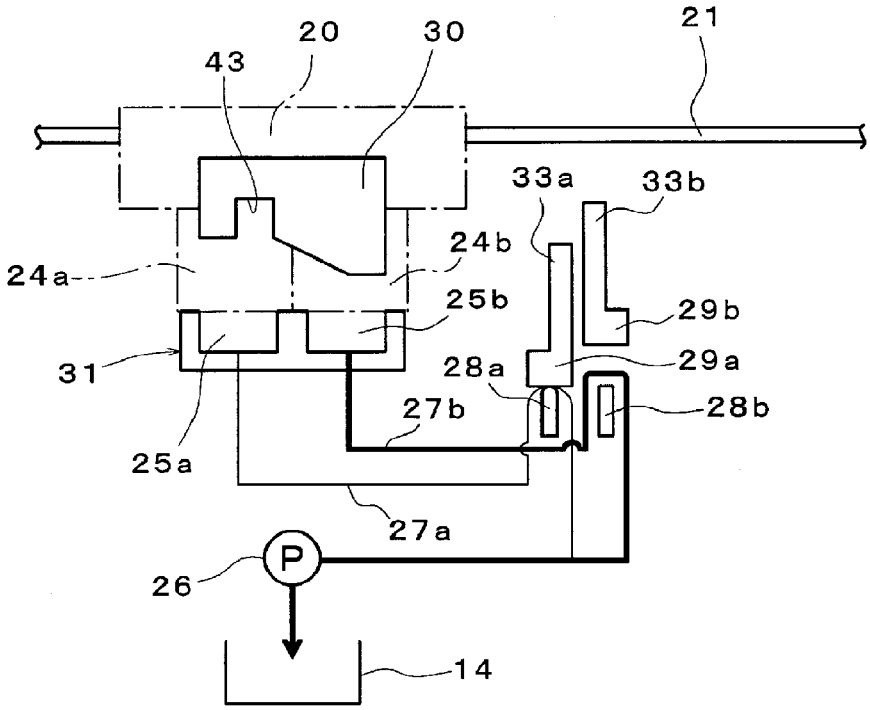

As shown in FIG. 8B, when the suction pump 26 is driven in this state, since the communication of the suction channel of the second tube member 27*b* is maintained, a suction operation is performed on the second cap space 25*b*, and the second recording head 24*b* discharges ink from its nozzles, causing a cleaning operation to be performed on the second recording head 24*b*. In contrast, since the suction channel of the first tube member 27*a* is cut off, the suction operation is not performed on the first cap space 25*a*, and a cleaning operation is not performed on the first recording head 24*a*.

Next, descriptions will be made for the case where the second lever member 29*b* is selected for a lever operation, the second tube member 27*b* is blocked while maintaining the communication of the first tube member 27*a*, and a suction operation is performed on the first suction space 25*a*, causing a cleaning operation to be performed on the first recording head 24*a*.

Figure 9A:
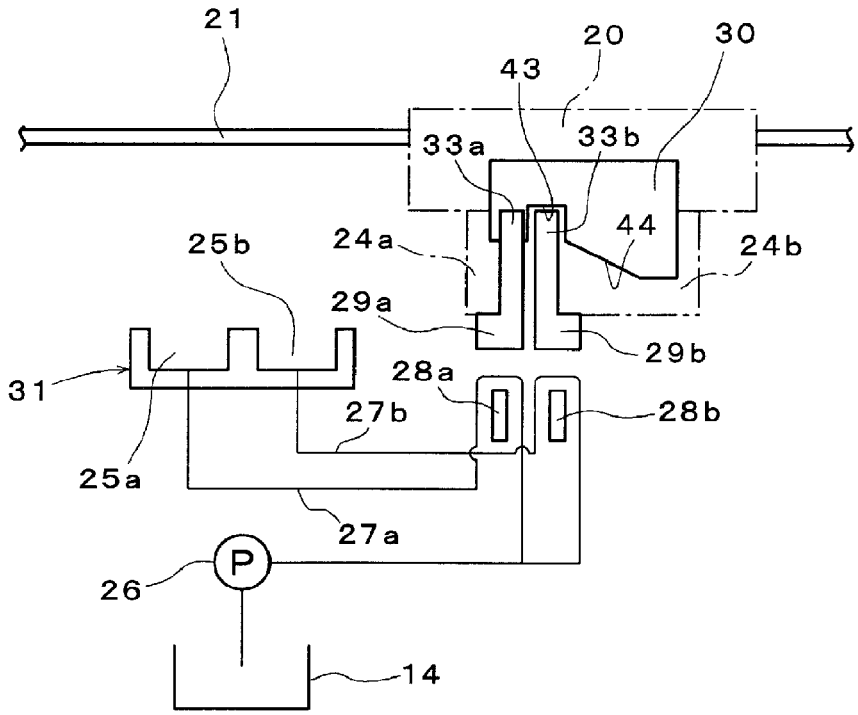
FIGS. 9A and 9B are diagrams illustrating the operation of the cleaning mechanism of the recording apparatus.

As shown in FIG. 9A, at a predetermined cleaning time for the first recording head 24*a*, the carriage 20 is moved to one of the lever selecting positions, for example the second position (see FIG. 7B).

As described above, by rotating the shaft 35 in this state, the head portion 33*b* of the second lever member 29*b* is inserted into the cutout portion 43 and is thus selected for the lever operation, while the head portion 33*a* of the first lever member 29*a* makes contact with the plate portion of the heteromorphic member 30, causing the pivot operation of the first lever member 29*a* to stop. The second lever member 29*b* is pivoted until the rear end of the head portion 33*b* is disposed at a height corresponding to the inclined surface 44, wherein the pivot operation is stopped. Subsequently, the carriage 20 is further moved toward the home position. At this time, the second lever member 29*b* is pivoted in such a way that the rear end of the head portion 33*b* is pressed against the inclined surface 44, causing the second lever member 29*b* to perform the lever operation. During the lever operation, the pressing portion 40 of the second lever member 29*b* is pressed in such a way that the inner surfaces of the pressing portion 40 and the tube seat 28 thereof are in close contact with each other, causing the communication of the suction channel formed by the second tube member 27*b* to be cut off.

Subsequently, the cap member 31 is moved upward to bring the upper end of the cap member 31 into close contact with the nozzle faces of the first and second recording heads 24*a* and 24*b*. Then, the nozzle faces of the first recording head 24*a* are capped by the first cap space 25*a*, and the nozzle faces of the second recording head 24*b* are capped by the second cap space 25*b*.

Figure 9B:
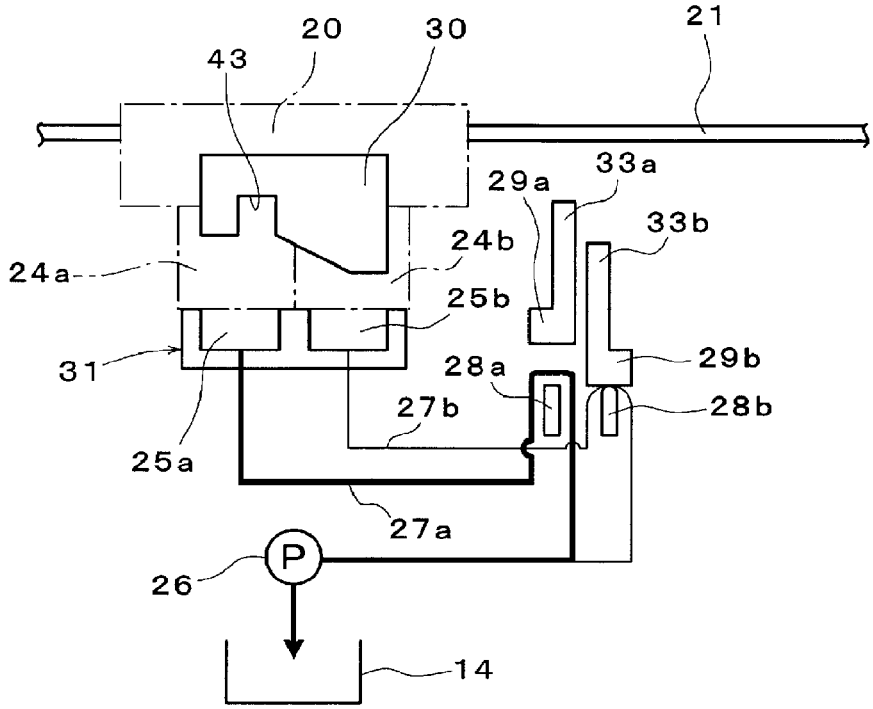

As shown in FIG. 9B, when the suction pump 26 is driven in this state, since the communication of the suction channel of the first tube member 27*a* is maintained, a suction operation may be performed on the first cap space 25*a*. During the suction operation, the first recording head 24*a* discharges ink from the nozzles, causing a cleaning operation to be performed on the first recording head 24*a*. Meanwhile, since the suction channel of the second tube member 27*b* is cut off, the suction operation is not performed on the second cap space 25*b*, and a cleaning operation is not performed on the second recording head 24*b*.

Next, descriptions will be made for the case where neither the first nor the second lever members 29*a* and 29*b* are selected for a lever operation, meaning that the communication of the first and second tube members 27*a* and 27*b* is maintained, and a suction operation is performed on both the first and second suction spaces 25*a* and 25*b*, causing a cleaning operation to be performed on both the first and second recording heads 24*a* and 24*b*.

Figure 10A:
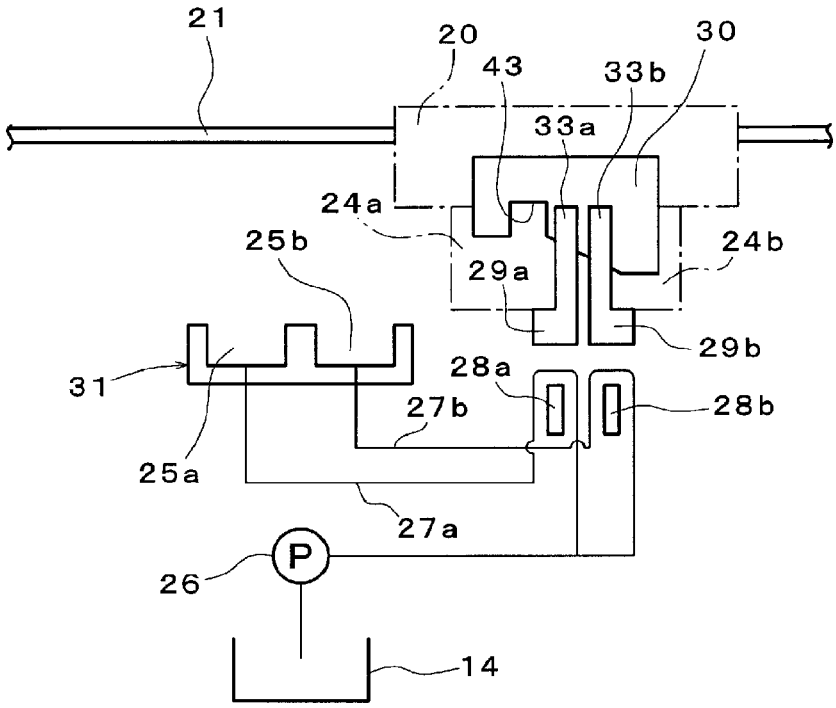
FIGS. 10A and 10B are diagrams illustrating the operation of the cleaning mechanism of the recording apparatus.

As shown in FIG. 10A, at a predetermined cleaning timing for cleaning both the first and the second recording heads 24*a* and 24*b*, the carriage 20 is moved to one of the lever selecting positions, for example the third position (see FIG. 7C).

As described above, by rotating the shaft 35, the head portions 33*a* and 33*b* of the first and second lever members 29*a* and 29*b* make contact with the plate portion of the heteromorphic member 30 and thus the pivot operations of the first and second lever members 29*a* and 29*b* are stopped. Next, the carriage 20 is further moved toward the home position. At this time, since neither the first nor the second lever members 29*a* and 29*b* perform the lever operation, the communication of the suction channels formed by the first and second tube members 27*a* and 27*b* is maintained.

Subsequently, the cap member 31 is moved upward to bring the upper end of the cap member 31 into close contact with the nozzle faces of the first and second recording heads 24*a* and 24*b*. Then, the nozzle faces of the first recording head 24*a* are capped by the first cap space 25*a*, and the nozzle faces of the second recording head 24*b* are capped by the second cap space 25*b*.

Figure 10B:
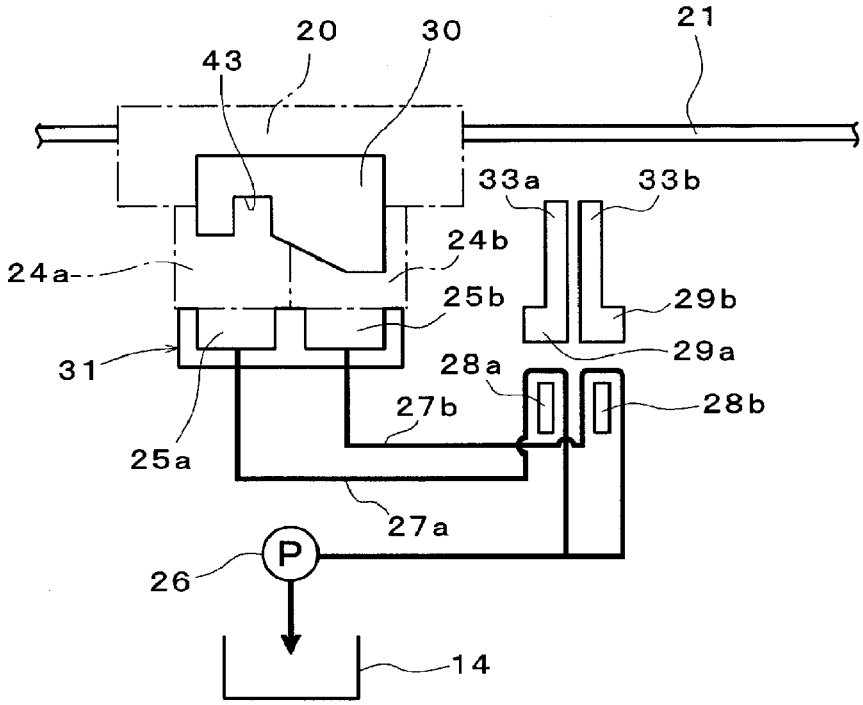

As shown in FIG. 10B, when the suction pump 26 is driven in this state, since the communication of the suction channel of the first tube member 27*a* is maintained, a suction operation is performed on the first cap space 25*a*, and the first recording head 24*a* discharges ink from the nozzles thereof, causing a cleaning operation to be performed on the first recording head 24*a*. Similarly, since the communication of the suction channel of the second tube member 27*b* is maintained, a suction operation is performed on the second cap space 25*b*, and the second recording head 24*b* discharges ink from the nozzles thereof, causing a cleaning operation to be performed on the second recording head 24*b*.

Using the embodiment described above, the following advantages can be achieved.

According to one embodiment of the invention, the suction channels are maintained or cut off based on the position of the carriage 20. By driving the suction pump 26 in this state, liquid may be sucked from the nozzles corresponding to the cap spaces 25 which correspond to the suction channels where the communication is maintained, while the liquid remains in the nozzles in the cap spaces 25 wherein the suction channels are cut off. In this way, it is possible to select, among the plurality of cap spaces 25, a cap space for liquid suction from the plurality of suction channels, based on the position of the carriage 20. That is, since the suction channels are selected by the movement of the carriage 20, it is not necessary to have the rotating cam or the sensor. Therefore, it is possible to select the cap space 25 for suction at low cost without complicating installation work. In addition, since the selection of suction channels is performed using the carriage 20 which is typically subjected to highly precise positioning or movement control, it is possible to select the cap for suction in a secure manner.

Second Embodiment

Figure 11A:
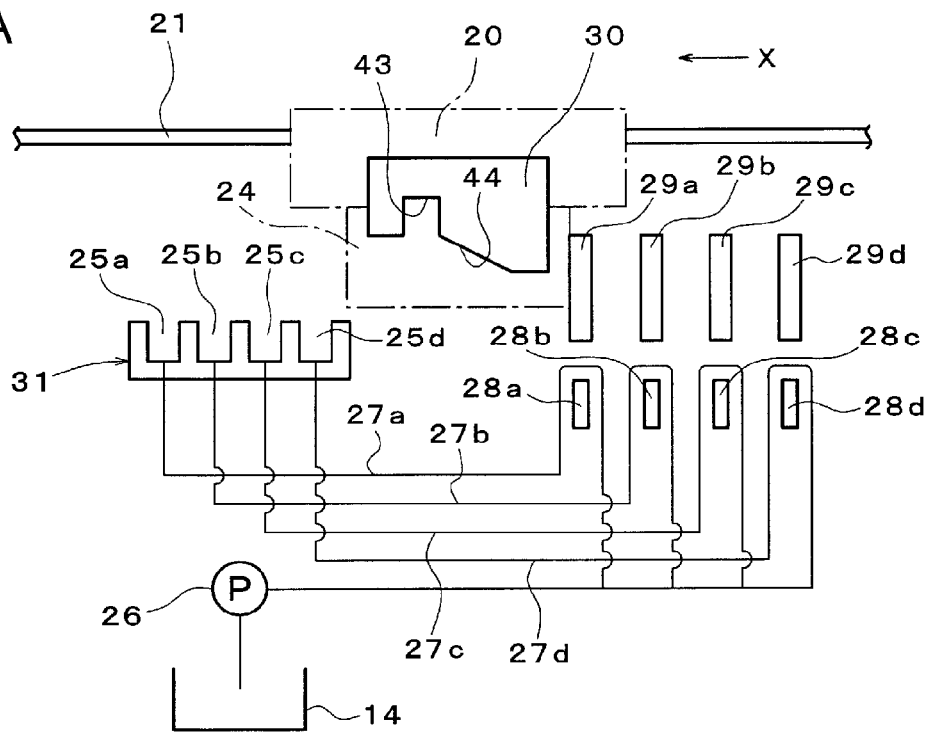
FIGS. 11A and 11B are diagrams showing a communication cut-off member in accordance with a second embodiment of the invention.

Hereinafter, a second embodiment of the invention will be described with reference to FIGS. 11A and 11B.

The first embodiment was described for the case where two recording heads 24*a* and 24*b* are provided to correspond to two cap spaces 25*a* and 25*b*, two tube members 27*a* and 27*b*, two tube seats 28*a* and 28*b*, and two lever members 29*a* and 29*b*, respectively.

In the present embodiment, one recording head 24 is provided with a plurality of nozzle arrays (i.e., four nozzle arrays are provided for each ink color of Y, M, C, and K). In addition, first to fourth cap spaces 25*a*, 25*b*, 25*c*, and 25*d* are prepared in the cap member 31 to correspond to the nozzle arrays. In addition, first to fourth tube members 27*a*, 27*b*, 27*c*, and 27*d*, first to fourth tube seats 28*a*, 28*b*, 28*c*, and 28*d*, first to fourth lever members 29*a*, 29*b*, 29*c*, and 29*d* are provided to correspond to the first to fourth cap spaces 25*a*, 25*b*, 25*c*, and 25*d*, respectively.

With such an arrangement, it is possible to cut off the communication of the first to fourth tube members 27*a* to 27*d* individually for each of the nozzle arrays.

Specifically, several lever members may be operated so as to maintain the communication of only one tube member while cutting off the communication of the remaining tube members, causing a cleaning operation to be performed on only one nozzle array corresponding to the tube member for which the communication is maintained. Alternatively, several lever members may be operated so as to maintain some of the tube members while cutting off the communication of the remaining tube members, whereby a cleaning operation is performed on several nozzle arrays corresponding to the tube members for which the communication is maintained. Alternatively, only one lever member may be operated so as to cut off the communication of only one tube member while maintaining the communication of the remaining tube members, whereby a cleaning operation is performed on several nozzle arrays corresponding to the remaining tube members for which the communication is maintained.

In the present embodiment, the operation in which only one lever member 29 is operated so as to cut off the communication of the tube member 27 is substantially the same as that of the first embodiment. Meanwhile, when several lever members 29 are operated so as to cut off the communication of the tube members 27, the lever members 29 are selected for a lever operation in the order of their proximity to the printable area disposed opposite the home position. That is, the lever member 29 disposed closest to the printable area is first inserted into the cutout portion 43 and is then moved to a position for a lever operation, activated by the pressing of the inclined surface 44 by the movement of the carriage 20. At this time, with the movement of the carriage 20, the lever member 29 disposed next to one disposed closer to the printable area is moved to the cutout portion 43 and is selected for a lever operation. In this manner, the remaining lever member 29 disposed close to the home position are sequentially selected for a lever operation.

Figure 11B:
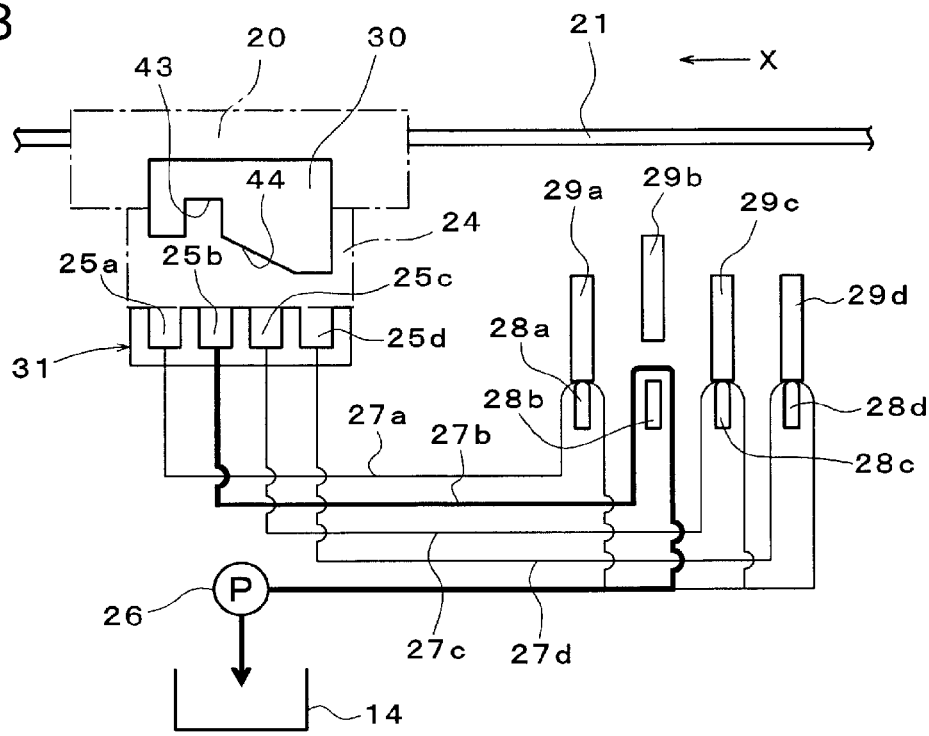

FIG. 11B shows the case where the first, third, and fourth lever members 29*a*, 29*c*, and 29*d* are selected for the lever operation so as to cut off the communication of the first, third, and fourth tube members 27*a*, 27*c*, and 27*d* while maintaining the communication of the second tube member 27*b*, meaning that a suction operation is performed on only the second cap space 25*b*, causing a cleaning operation to be performed on the nozzle array corresponding to the second cap space 25*b*. The present embodiment may be applied to the recording head having three or less nozzle arrays and may be applied to the recording head having five or more nozzle arrays. In the invention, one cap space may be configured to correspond to not only one nozzle array but also a plurality of nozzle arrays if the cleaning operation can be simultaneously performed on the plurality of nozzle arrays.

Modifications

The invention is not limited to the embodiments described above, but may be modified in various ways.

In the above-described embodiments, the suction pump may employ various pumps including a tube pump, a piston pump, and a diaphragm pump.

Hereinabove, the present invention was described in association with an ink jet recording apparatus having an ink jet recording head for image recording, as an example of a liquid ejecting apparatus. Examples of liquid ejecting apparatuses to which the invention may be applied include: an apparatus having a coloring material ejecting head used for manufacturing a color filer such as a liquid-crystal display or the like; an apparatus having an electrode material (conductive paste) ejecting head used for forming electrodes, such as an organic EL display or a field emission display (FED) or the like; an apparatus having a bio-organic substance ejecting head used for manufacturing a bio-chip; an apparatus having a sample ejecting head serving as a precision pipette; and the like.

What is claimed is:

1. A liquid ejecting apparatus, comprising: a liquid ejecting head capable of ejecting liquid from a plurality of nozzles;

a carriage capable of carrying the liquid ejecting head in a main scanning direction in a reciprocating manner;

a plurality of cap spaces capable of capping the plurality of nozzles so as to cover the nozzles;

a suction pump capable of applying a negative pressure to each of the cap spaces so that liquid is sucked from the plurality of nozzles;

a plurality of suction channels which communicate with the plurality of cap spaces, which are capable of carrying the liquid sucked by the suction pump;

a channel selection means capable of selecting one or more selected suction channels from the plurality of suction channels for stopped communication with the plurality of cap spaces based on the position of the carriage; and a communication cut-off means capable of stopping the communication of the one or more selected suction channels with the plurality of cap spaces.

2. The liquid ejecting apparatus according to claim 1, wherein the communication cut-off means stops the communication of the one or more selected suction channels by moving the carriage.

3. The liquid ejecting apparatus according to claim 1, wherein the suction channels comprise flexible tube members and the communication cut-off means comprise lever members corresponding to the flexible tube members capable of performing a lever operation which presses and blocks a corresponding tube member, and wherein the channel selecting means selects a tube member by selecting a corresponding lever member.

4. The liquid ejecting apparatus according to claim 3, wherein the channel selecting means comprises a lever selecting section located in the carriage, which is capable of selecting one or more of the lever members based on the position of the carriage.

5. The liquid ejecting apparatus according to claim 4, wherein the channel cut-off means includes a lever activating section located in the carriage which is capable of allowing the one or more lever members selected by the lever selecting section to perform the lever operation while the carriage is moving.

6. The liquid ejecting apparatus according to claim 4, wherein the lever members are driven by a lever driving means, wherein the carriage further comprises a drive stopping member that prevents the lever members from contacting the lever members driven by the lever driving means, wherein the lever selecting section comprises a cutout portion bored through the drive stopping member, and wherein the lever member is selected by inserting the lever member into the cutout portion by the lever driving means.

7. The liquid ejecting apparatus according to claim 6, wherein the lever activating section comprises an inclined portion that presses the selected lever member so as to perform the lever operation while the carriage is moving.

8. A liquid ejecting apparatus, comprising: a liquid ejecting head capable of ejecting liquid from a plurality of nozzles;

a carriage capable of carrying the liquid ejecting head in a main scanning direction in a reciprocating manner;

a plurality of cap spaces capable of capping the plurality of nozzles so as to cover the nozzles;

a suction pump capable of applying a negative pressure to each of the cap spaces so that liquid is sucked from the plurality of nozzles;

a plurality of suction channels which communicate with the plurality of cap spaces, which are capable of carrying the liquid sucked by the suction pump;

a channel selection means capable of selecting one or more selected suction channels from the plurality of suction channels for stopped communication with the plurality of cap spaces based on the position of the carriage; and a communication cut-off means capable of stopping the communication of the one or more selected suction channels by moving the carriage.

9. The liquid ejecting apparatus according to claim 8, wherein the suction channels comprise flexible tube members and the communication cut-off means comprise lever members corresponding to the flexible tube members capable of performing a lever operation which presses and blocks a corresponding tube member, and wherein the channel selecting means selects a tube member by selecting a corresponding lever member.

10. The liquid ejecting apparatus according to claim 9, wherein the channel selecting means comprises a lever selecting section located in the carriage, which is capable of selecting one or more of the lever members based on the position of the carriage.

11. The liquid ejecting apparatus according to claim 10, wherein the channel cut-off means includes a lever activating section located in the carriage which is capable of allowing the one or more lever members selected by the lever selecting section to perform the lever operation while the carriage is moving.

12. The liquid ejecting apparatus according to claim 10, wherein the lever members are driven by a lever driving means, wherein the carriage further comprises a drive stopping member that prevents the lever members from contacting the lever members driven by the lever driving means, wherein the lever selecting section comprises a cutout portion bored through the drive stopping member, and wherein the lever member is selected by inserting the lever member into the cutout portion by the lever driving means.

13. The liquid ejecting apparatus according to claim 12, wherein the lever activating section comprises an inclined portion that presses the selected lever member so as to perform the lever operation while the carriage is moving.

* * * * *